US005580098A

United States Patent [19]

Gates

[11] Patent Number: 5,580,098

[45] Date of Patent: Dec. 3, 1996

[54] CHILDREN'S BOOK WITH HANDLE-OPERATED ANIMATION

[75] Inventor: Charles E. Gates, Pacific Palisades, Calif.

[73] Assignee: Intervisual Books, Inc., Santa Monica, Calif.

[21] Appl. No.: 372,452

[22] Filed: Jan. 13, 1995

[51] Int. Cl.[6] ..... B42D 1/00

[52] U.S. Cl. ..... 281/38; 446/147

[58] Field of Search ..... 281/38, 51, 43; 402/79, 80 R; 446/147, 151, 152

[56] References Cited

U.S. PATENT DOCUMENTS

| | | | |
|---|---|---|---|
| 639,679 | 12/1899 | Kaufmann . | |
| 2,367,373 | 1/1945 | Ralston | 446/151 |
| 2,554,098 | 5/1951 | Eisner | 446/151 |
| 2,689,751 | 9/1954 | Baller | 446/151 X |
| 3,199,238 | 8/1965 | Brown . | |
| 4,031,850 | 6/1977 | Gantt . | |
| 4,487,590 | 12/1984 | Becker et al. | 446/147 |
| 4,616,851 | 10/1986 | Mann | 281/43 |
| 4,712,673 | 12/1987 | Moore | 281/43 |
| 5,287,641 | 2/1994 | Showers . | |

*Primary Examiner*—Willmon Fridie, Jr.
*Attorney, Agent, or Firm*—Poms, Smith, Lande & Rose, Professional Corporation

[57] ABSTRACT

A children's book has a number of slidable pages. Each slidable page has a inner page assembly bound between a pair of cover by a binding and linked to an outer page assembly by a linking member. A handle is secured to each outer page assembly and extends beyond the covers. The page assemblies and the linking member have text and/or illustrations printed thereon. The linking member is slidably received within each page assembly and retained therein by a retention member. As a child pulls outwardly on the handle, the page assemblies separate and expose the linking member and illustrations printed thereon. The handles may, alternatively, actuated other movable structural features mounted in or on the pages.

13 Claims, 4 Drawing Sheets

FIG. 1
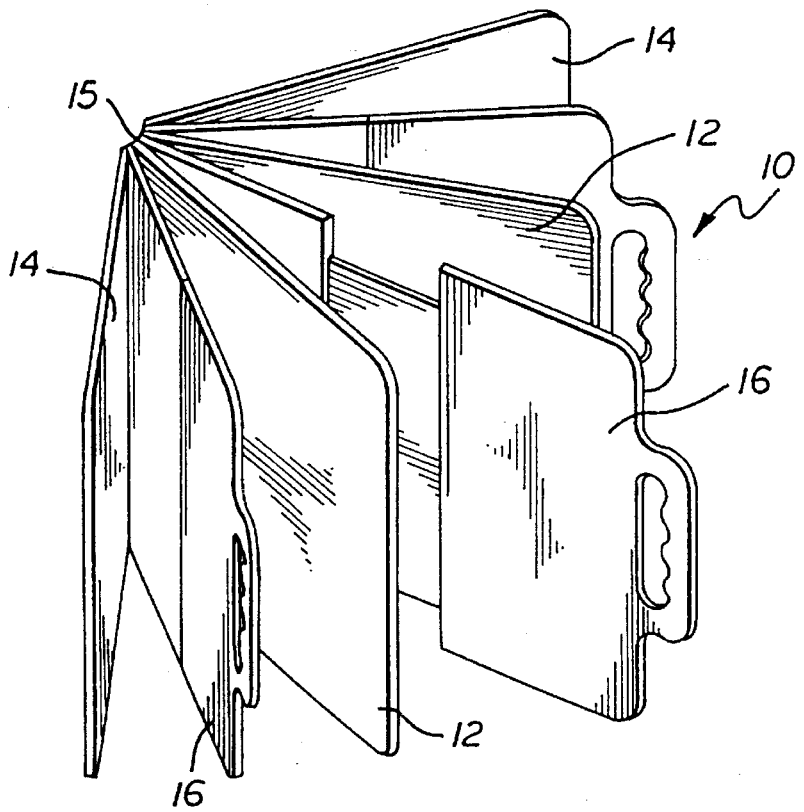
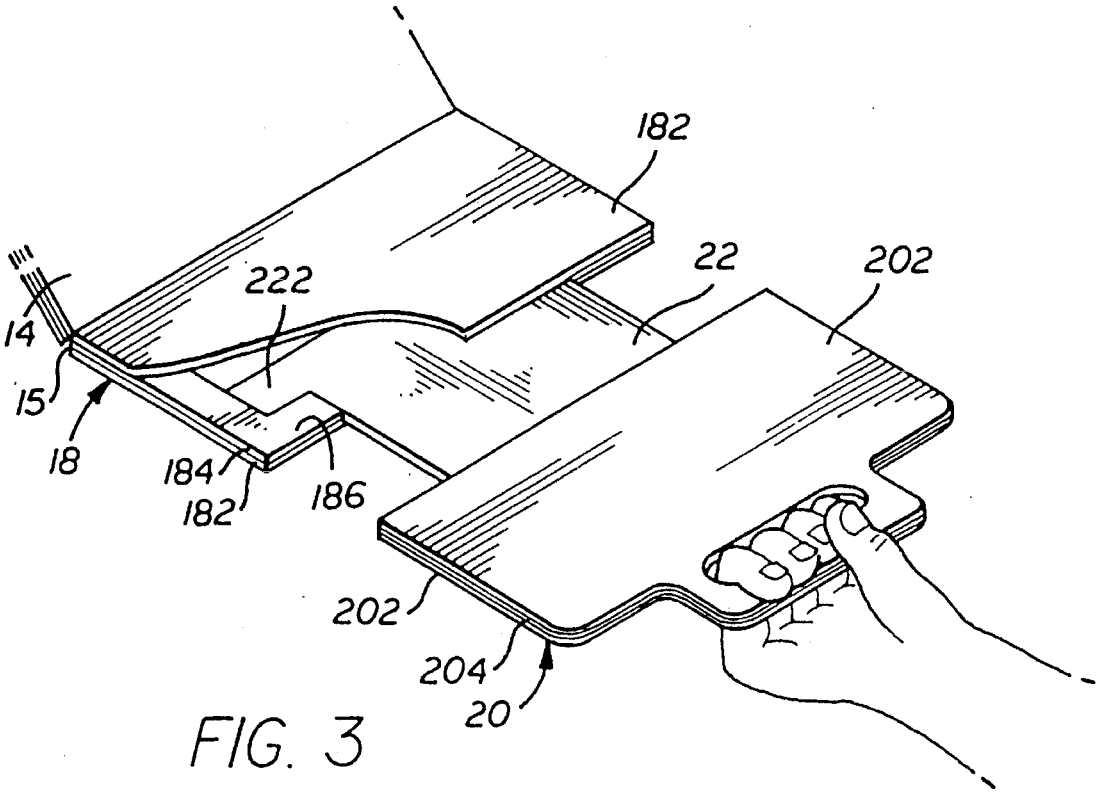
FIG. 3

FIG. 4A
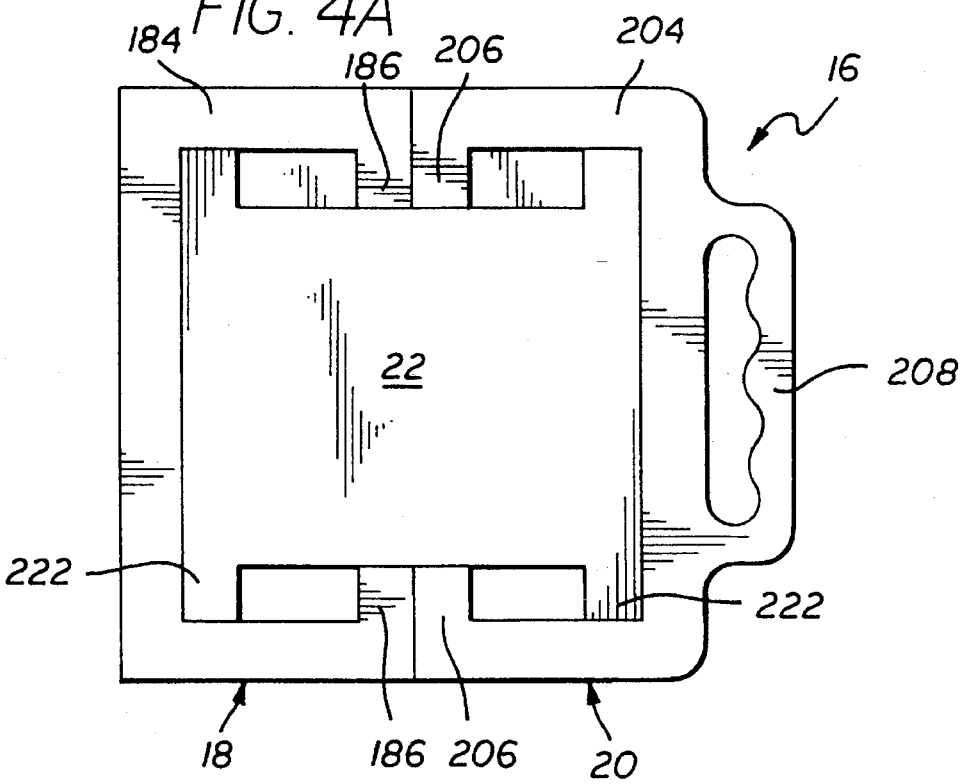
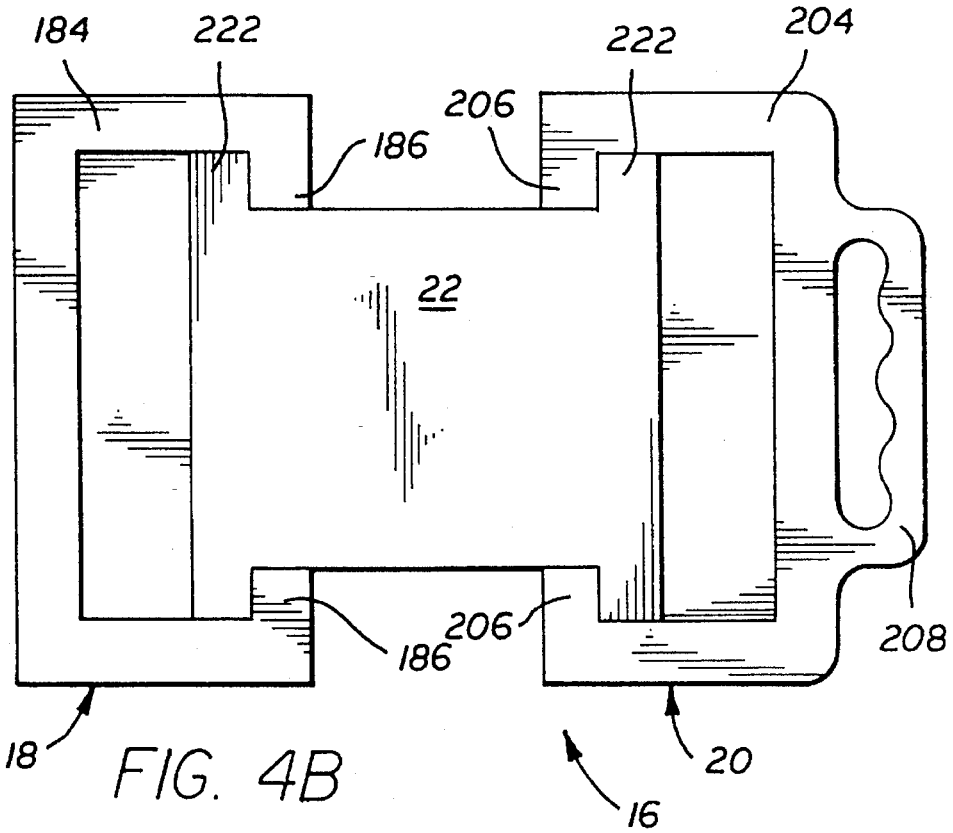
FIG. 4B

FIG. 5A
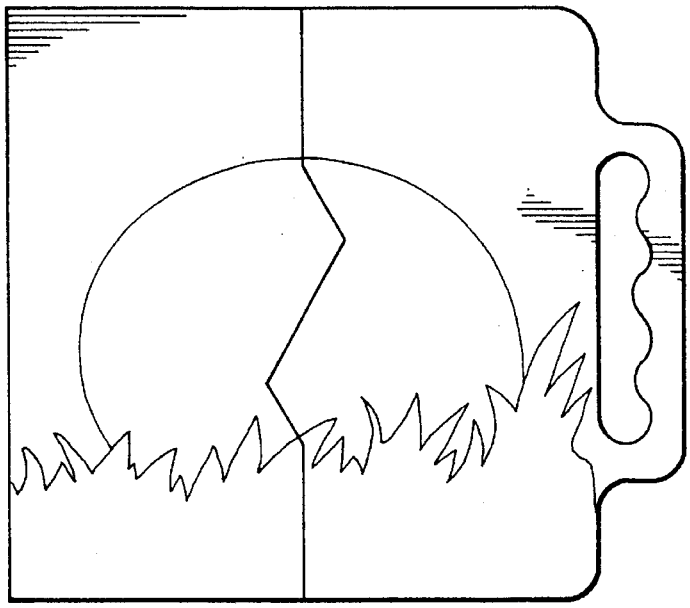
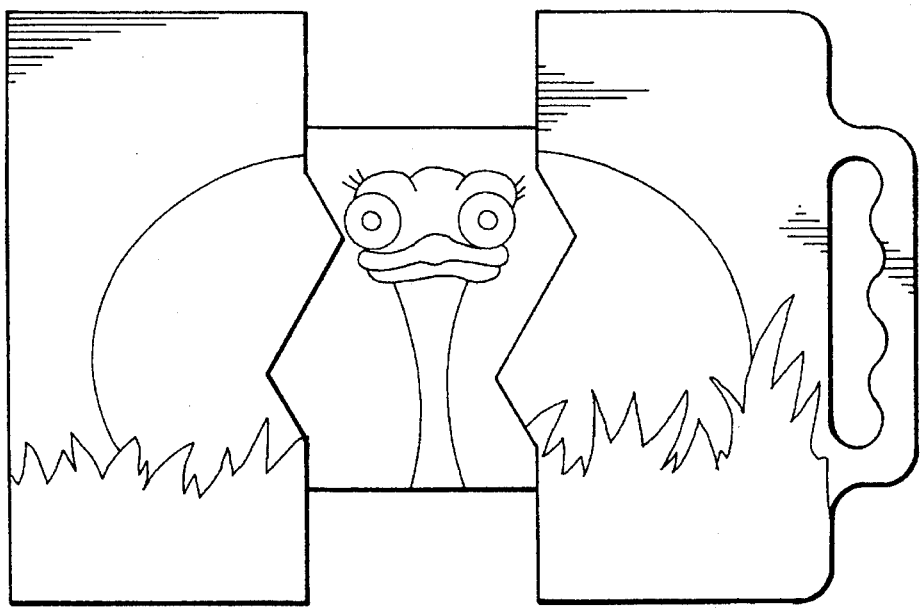
FIG. 5B

CHILDREN'S BOOK WITH HANDLE-OPERATED ANIMATION

FIELD OF THE INVENTION

The present invention relates to children's books, particularly children's books having slidable pages with physical and visual entertainment features.

BACKGROUND OF THE INVENTION

It is common for children's books to incorporate physical entertainment features along with illustrations and text. These features are often dynamic, providing interest for the child. These features are also often intended to be manipulated by the child to add further interest and interaction and to develop motor skills such as hand coordination. A drawback of the prior entertainment features is that they are often fragile, unable to withstand repeated and misdirected abuse by children. Furthermore, the features which require physical interaction are often poorly designed so as to be difficult for a young child with underdeveloped motor skills to easily manipulate.

The prior art also teaches of children's books which incorporate handles into their designs. One such book, disclosed by U.S. Pat. No. 4,616,851, has a number of pages each with an opening in a top portion thereof for receiving the fingers of a child. These openings act as a handle for carrying the book when it is closed but serve no other function. Another book, disclosed by U.S. Pat. No. 4,487,590, has pairs of handles formed in facing pages which simulate handles for various steering apparatuses of vehicles. The handles also function as a carrying device when the book is closed.

Although the children's books described above take into consideration handles which are dimensioned for a child's hand, they do not involve handles cooperating with movable entertainment features which may be incorporated in the book. Therefore, there is a need in the art of children's books for a book with physical and visual entertainment features which are easily manipulated by a child.

SUMMARY OF THE INVENTION

According to one preferred illustrative embodiment of the present invention, a children's book which is manually changeable and easily accessible has a number of slidable pages disposed between a pair of covers. Each slidable page has a movable outer portion with a handle secured thereto. The handle has an opening suitably dimensioned so as to accommodate the fingers of a small child. Therefore, the child may pull on the handle to move the outer portion of the page outwardly, exposing a further view of the subject matter shown on the page. Handles may project beyond the covers of the book and may also be disposed thereon so that the book may be carried by the handles when closed.

In accordance with another aspect of the invention, each slidable page comprises an inner page assembly which is coupled to an outer page assembly by means of a linking member. The linking member is slidably retained within the page assemblies and has illustrations and/or text printed thereon, such that when a child pulls on the handle, the outer page assembly moves, thereby exposing the linking member.

Each page assembly may include a retention member sandwiched between a pair of facesheets having illustrations and/or text printed thereon. The retention member is substantially U shaped with inwardly turned ends such that the linking member is slidably receivable therein. The linking member has detents formed thereon which are engageable with retaining portions of the retention members. Therefore, when a child pulls outwardly on the handle, the outer page assembly moves outwardly and the retaining portions of the retention member thereof engage with the detents of the linking member. Accordingly, the linking member moves outwardly until further detents engage with retaining portions of the retention member of the inner page assembly. Preferably, correlative illustrations are printed on the linking member and the facesheets so as to stimulate the interest of the child.

As may be realized, the slidable pages should be made out of fairly rigid or stiff paperboard so as to be durable and to ensure a smooth sliding operation. Furthermore, it is preferable for nonsliding pages containing text and/or illustrations to be interspaced with the sliding pages, which may contain illustrations.

In accordance with another aspect of the invention, the pages of the book include movable portions for changing the configurations of pages. Handles are mechanically connected to the movable portions such that when a child pulls outwardly on the handles, the movable portions move accordingly. The movable portions contain a linking member coupled to the handles.

Additional objects, advantages and features of the invention become will apparent upon examination of the following detailed description and the accompanying drawings.

BRIEF DESCRIPTION OF THE DRAWINGS

FIG. 1 is a perspective view of a children's book with sliding pages, illustrating the principles of the present invention;

FIG. 3 is a cut-away view of the sliding page;

FIG. 4A is a plan view of the sliding page shown in a closed position;

FIG. 4B is a plan view of the sliding page shown in an extended position;

FIG. 5A is a plan view of a sliding page according to a preferred embodiment of the present invention shown in a closed position; and FIG. 5B is a view similar to FIG. 5A but shown in an extended position.

DETAILED DESCRIPTION OF THE PREFERRED EMBODIMENTS

Figure 2:
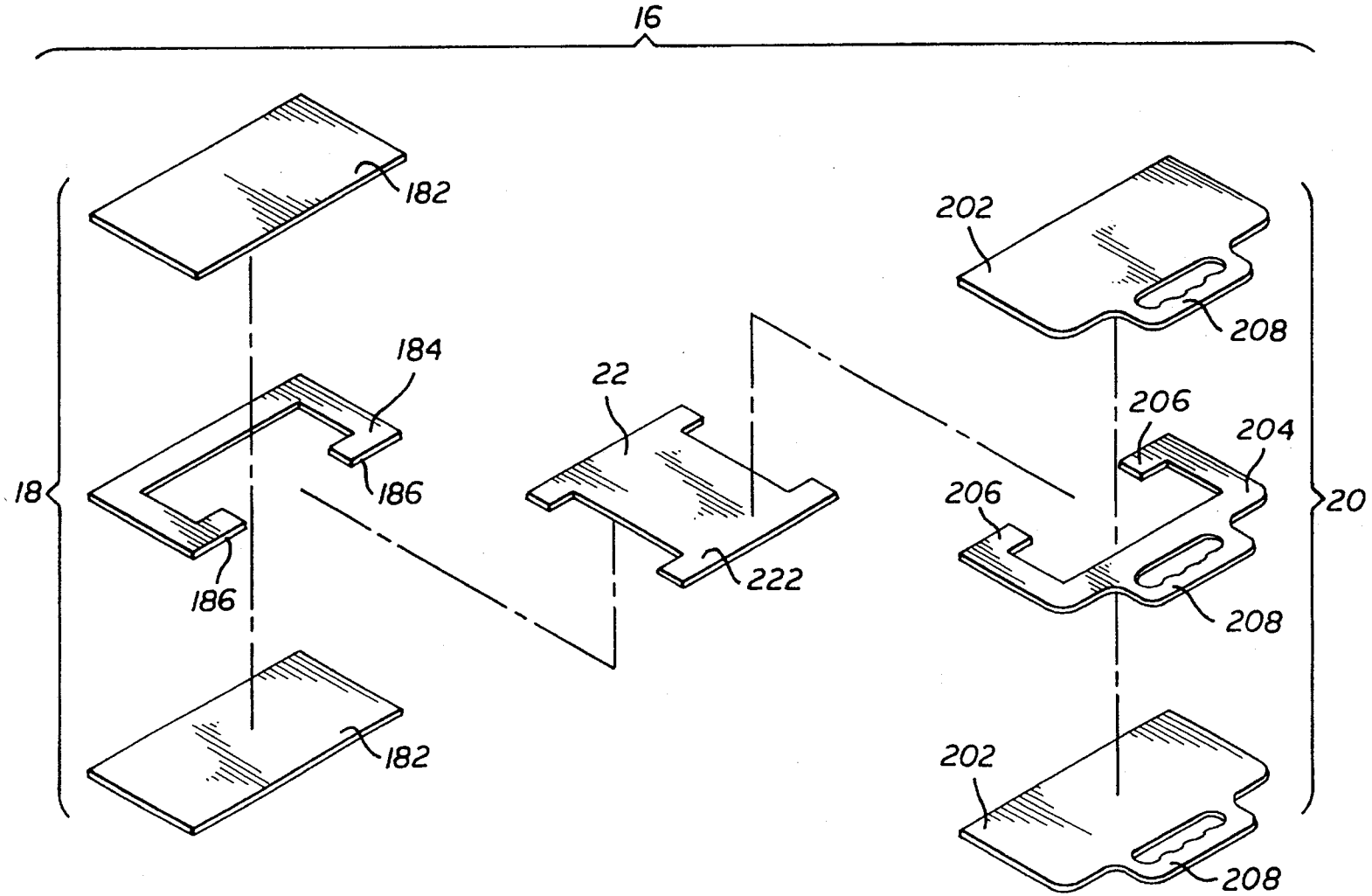
FIG. 2 is an exploded view of a sliding page of the children's book with sliding pages.

Referring to the drawings, particularly to FIG. 1, a children's book 10 according to a preferred embodiment of the present invention is shown in perspective. The children's book 10 generally comprises a plurality of pages 12 bound to a pair of covers 14 by a binding 15. The children's book 10 further comprises a plurality of sliding pages 16 which possess entertainment features encouraging interaction with a child.

With additional reference to FIG. 2, a sliding page 16 is shown in an exploded format to reveal the structure thereof. The sliding page 16 generally comprises a pair of page assemblies, an inner page assembly 18 and an outer page assembly 20. A linking member 22 is slidably retained within the page assemblies 18 and 20 and thereby links the page assemblies 18 and 20 together.

The inner page assembly 18 is bound to the binding 15 and comprises a pair of facesheets 182 and a retention member 184 having a pair of retaining portions 186 disposed thereon and being sandwiched between the facesheets 182. Similarly, the outer page assembly 20 comprises a pair of facesheets 202 and a retention member 204 having a pair of retaining portions 206 disposed thereon and being sandwiched between the facesheets 202. The retention member 184 and 204 are substantially U shaped with the ends thereof turned inwardly.

The children's book 10 further comprises a handle 208 formed on or mechanically connected to an outside portion of each outer page assembly 20. The handle 208 extends outwardly from the book, preferably beyond the covers 14. Each cover 14 may also have a handle secured thereto which has substantially the same configuration as the handles 208, such that a child is able to carry the book when closed by grasping the handles 208 collectively.

As young children typically have not developed a high level of dexterity or motor coordination in their fingers, the handle 208 is dimensioned to enable a child to easily grasp and manipulate the handle 208. Specifically, the opening of the handle 208 is sufficiently sized so that a child is able to insert his or her fingers less the thumb into the opening of the handle 208. This act is easier for a child to perform than somehow grasping a handles between his or her index finger and thumb. Therefore, a child is readily able to manipulate the sliding pages 16 without adult assistance.

With additional reference to FIG. 3, it can be seen that a chamber is formed within the page assemblies 18 and 20. The linking member 22 has detents 222 formed on opposite ends thereof, thereby yielding the linking member 22 substantially I-shaped. The detents 222 are respectively received in the chambers of the page assemblies 18 and 20.

The linking member 22 and the retention members 184 and 204 are sized such that the portion of the linking member 22 on which illustrations or text is printed (the middle portion) slides between the retaining portions 186 and 206, and that the detents 222 of the linking member 22 engage with or catch on the retaining portions 186 and 206; that is, the width of the middle portion of the linking member 22 is substantially equal to the distance between the respective pairs of retaining portions 186 and 206, and the width of the detents 222 of the linking member 22 is greater than the distance between the respective pairs of retaining portions 186 and 206.

As can be realized, the facesheets 182 and 202, the retention members 184 and 204, and the linking member 22 are preferably made from fairly rigid or stiff paperboard, such that the linking member 22 will not bend to the point of kinking or creasing when having a normally-occurring force acted thereupon. Furthermore, the thickness of the linking member 22 and the thickness of the retention members 184 and 204 are substantially equal so as to minimize the space between the facesheets 182 and 202 and the linking member 22, thereby reducing to a large extent the amount of play in the linking member 22.

Referring to FIG. 4A, the sliding page 16 is shown with the facesheets 182 and 202 removed and in a closed position. While in the closed position, the page assemblies 18 and 20 abut each other, and the detents 222 of the linking member 22 are spaced from the retaining portions 186 and 206. When a child pulls outwardly on the handle 208, the outer page assembly 20 moves outwardly and the retaining portions 206 engage with the detents 222 of the linking member 22, thereby urging the linking member 22 outwardly. The linking member 22 moves out of the inner page assembly 18 until the retaining portions 186 engage with the other detents 222 of the linking member 22. The sliding page 16 is now in an extended position, as shown in FIG. 4B, with the linking member 22 exposed.

To return the sliding page 16 to the closed position, the child simply pushes inwardly on the handles 208. The outer page assembly 20 moves inwardly, and the detents 222 of the linking member 22 abut the retention member 204, thereby urging the linking member 22 into the inner page assembly 18. As the page assemblies 18 and 20 and the linking member 22 are made from fairly rigid or stiff paperboard, the above-described operation proceeds with minimal binding and kinking.

Referring to FIGS. 5A and 5B, a preferred embodiment of the present invention is shown. A sliding page is shown with an illustration of something which splits apart, specifically an egg. The egg is equally drawn on the facesheets 182 and 202 such that when a child pulls outwardly on the handle 208, the contents of the egg are shown on the linking member 22, for example, a chick. This preferred embodiment teaches a child about animals which are born from eggs. As can be seen, the common edges of the page assemblies 18 and 20 may be irregular or jagged so as to be similar to the edges of a broken egg shell.

With further reference to FIG. 1, the children's book 10 preferably has the pages 12 interspaced or alternated with the sliding pages 16. By having this relationship, text may be suitably printed on the nonsliding pages 12 and corresponding illustrations may be printed on the sliding pages 16. Specifically, the text may pose a riddle with the answer revealed by pulling the sliding page 16 to the open position.

To more specifically define the children's book 10 according to an illustrative embodiment of the invention, the book 10 is substantially rectilinear with dimensions of approximately 7¾ inches by 6¼ inches by ½ inch for a book having three sliding pages 16, two nonsliding pages 12, and a pair of covers 14. The handles 208 project approximately 1½ inches beyond the covers 14 and have dimensions of approximately 2¼ to 2½ inches by approximately ¾ inch, thereby sufficiently receiving the fingers of a small child. Each sliding page 16 is approximately ⅛ inch thick and extends about 2¾ inches. In order for substantial illustrations to be printed thereon, the linking member 22 should be approximately four to five inches from top to bottom.

Although the above-described preferred embodiment highlights an enhanced children's book with a plurality of sliding pages, the present invention is not to be limited to the specific embodiments shown in the drawings and described in the detailed description. Thus, by way of example and not of limitation, the handles 208 may be employed to manipulate movable portions of the pages. The movable portions may be contained within the pages such that a smaller portion of the page or supplemental material mounted in or on the page is actuated by a movement of the handle, not necessarily the entire outer portion of the page. The text and/or illustrations printed on the movable portion may be correlative to that printed on the portion of the page which does not move.

Accordingly, in the foregoing disclosure there is shown and described only the preferred embodiments of a children's book according to the invention, but it is to be understood that the invention is capable of changes or modification within the scope of the inventive concept as expressed herein.

What is claimed is:

1. A manually-changeable, easily-accessible children's book, comprising:

covers, pages, and a binding securing said pages within said covers;

a selected plurality of said pages including a slidable outer portion movable outwardly to expose additional visual material; and a handle including an opening for receiving the fingers of a child and being secured to said outer portion of said pages, said handles extending outwardly from said book beyond said covers.

2. A children's book as claimed in claim 1, wherein:

each said page of said selected plurality of pages comprises an inner page assembly being bound at an inner side thereof to said binding and having an opening defined in an outer side thereof, an outer page assembly having an opening defined in an inner side thereof, and a linking member being slidably received through said openings;

each said handle being secured to said outer page assembly;

whereby when said handle is pulled outwardly, said outer page assembly is urged outwardly, exposing said linking member, and said linking member is urged out of said inner page assembly, further exposing said linking member.

3. A children's book as claimed in claim 2, wherein:

each said inner page assembly comprises a pair of facesheets and a retention member, said retention member being disposed between said facesheets and having a partially open end thereof defining said opening of said inner page assembly;

each said outer page assembly comprises a pair of facesheets and a retention member, said retention member being disposed between said facesheets and having a partially open end thereof defining said opening of said outer page assembly; and said linking member slidably extends into both said page assemblies and comprises detents for engaging with retaining portions of said retention members.

4. A children's book as claimed in claim 3, wherein the width of said linking member is substantially equal to the width of said partially open ends of said retention members;

whereby said linking member slides through said partially open ends without a significant amount of play.

5. A children's book as claimed in claim 3, wherein the thickness of said linking member is substantially equal to the thickness of said retention members;

whereby said linking member slides through said partially open ends without a significant amount of play.

6. A children's book as claimed in claim 3, wherein:

each said retention member is substantially U shaped with said retaining portions being oppositely disposed across said partially open end thereof; and said linking member is substantially I shaped with said detents being disposed on opposite ends thereof.

7. A children's book as claimed in claim 3, wherein said facesheets, said retention member, and said linking member are made from fairly rigid or stiff paperboard.

8. A children's book as claimed in claim 1, wherein the pages of said book include slidably extendable pages as defined herein, alternated with nonslidably extendable pages.

9. A children's book as claimed in claim 1, wherein said covers have handles secured to outer portions thereof; said handles of said covers having substantially the same configuration as said handles of said pages;

whereby a child is able to grasp said handles collectively to carry said book.

10. A children's book as claimed in claim 1, wherein inside edges of said page assemblies are correspondingly jagged or irregular;

whereby said inside edges simulate the edges of a broken egg or the like.

11. A manually-changeable, easily-accessible children's book, comprising:

covers, pages, and a binding securing said pages within said covers;

a selected plurality of said pages comprising movable portions for changing the configurations of said pages; and a handle mechanically connected to said movable portions of each said page, said handles extending outwardly from said book beyond said covers;

each said page of said selected plurality of pages comprising an inner page assembly being bound to said binding, an outer page assembly having said handle secured thereto, and a linking member being slidably retained within said page assemblies and being exposed upon an outwardly movement of said outer page assembly.

12. A children's book as claimed in claim 11, wherein:

each said page assembly comprises a retaining member; and said linking member comprises detents, said detents being engageable with said retaining members.

13. A manually-changeable, easily-accessible children's book, comprising:

a pair of covers, a plurality of pages, a binding securing said pages within said covers, and a handle being secured to said pages;

a selected plurality of said pages being slidable and interspaced with nonslidable said pages;

each said slidable page comprising:

an inner page assembly being bound at an inner side thereof to said binding and having a retention member disposed between a pair of facesheets;

an outer page assembly having a retention member disposed between a pair of facesheets; and a linking member having detents formed thereon being slidably receivable in said page assemblies and respectively retained in said page assemblies by said detents engaging with retaining portions of said retention members;

said handles being secured to said outer page assembly and projecting outwardly beyond said covers of said book;

said facesheets and said linking member having correlative text and/or illustrations printed thereon;

whereby when a child pulls outwardly on said handle, said outer page assembly and said linking member move outwardly, exposing said linking member.

* * * * *